United States Patent [19]

Andersen

[11] Patent Number: 4,507,018

[45] Date of Patent: Mar. 26, 1985

[54] WAVE MAKING MACHINES

[76] Inventor: Per F. Andersen, 501-3755 Bartlett Ct., Burnaby, B.C., Canada, V3J 7G7

[21] Appl. No.: 392,452

[22] Filed: Jun. 24, 1982

[51] Int. Cl.[3] ..... E02B 3/00

[52] U.S. Cl. ..... 405/79; 4/491

[58] Field of Search ..... 405/28, 79; 4/491

[56] References Cited

U.S. PATENT DOCUMENTS

| | | | |
|---|---|---|---|
| 3,789,612 | 2/1974 | Richard et al. | 405/79 |
| 3,973,405 | 8/1976 | Duport | 405/79 |
| 4,201,496 | 5/1980 | Andersen | 405/79 |

FOREIGN PATENT DOCUMENTS

| | | | |
|---|---|---|---|
| 163218 | 8/1933 | Switzerland | 405/79 |

*Primary Examiner*—David H. Corbin

*Attorney, Agent, or Firm*—Fetherstonhaugh & Co.

[57] ABSTRACT

A wave making machine for substantially unidirectional wave making on a water surface comprises at least one support scow, a plunger supported by each scow by means of a linkage which limits the movement of the plunger to substantially vertical movement and a drive mechanism for driving the plunger between a raised position and a lowered position. The plunger has a front face at least a portion of which is upwardly and forwardly inclined and a back face which is substantially vertically oriented whereby upon periodic motion waves are generated at the front face and substantially no waves are generated at the back face of the plunger. A plurality of scows, each supporting a wave making plunger, may be connected in a side by side relationship to form a laterally elongated wave making mechanism. The scrows are connected by movable linkage mechanisms which permit independent movement of each adjacent scow.

7 Claims, 3 Drawing Figures

WAVE MAKING MACHINES

FIELD OF THE INVENTION

This invention relates to improvements in wave making machines.

In particular, this invention relates to an improved wave making machine which serves to generate waves in a first direction without generating waves in a second direction opposite said first direction.

PRIOR ART

When attempting to generate waves by raising and lowering a plunger on the surface of a body of water, waves are usually generated both fore and aft of the plunger. The waves which are generated aft of the plunger are undesirable and must be dissipated or reflected forward. Heretofore the practice has been to provide a back board in close proximity to the back face of the plunger against which the aft waves are reflected.

In my prior U.S. Pat. No. 3,477,233 dated Nov. 11, 1969 I disclosed a wave making machine which consists of a buoyant plunger which is moored to float adjacent a back board. The floating plunger is held in an upright position by means of submerged counter weights. An oscillating drive mechanism consisting of a weight displacement mechanism is mounted on the plunger. A back board is supported by piling driven into the bed of the body of water.

In my U.S. Pat. No. 4,201,496 dated May 6, 1982 there is disclosed a wave making machine which consists of a buoyant plunger which is held in an upright position by an outrigger float. A back board is fixed to the plunger member a substantial distance rearwardly thereof.

I have now discovered that a substantially unidirection of wave propagation can be obtained by employing a plunger in which the back face is substantially planer and vertically oriented and the front face includes a portion which is upwardly and forwardly inclined and by providing a mechanism which ensures that the plunger reciprocates substantially vertically.

I have also found that a plunger of a wave making machine can conveniently be supported by means of a scow which can be moored and anchored in a conventional manner so as to retain its required position with respect to the direction in which waves are to be generated.

I have also found that a plurality of wave making machines each consisting of a scow and a wave making plunger can be connected to one another in a side by side relationship by connecting the scows in a manner so as to permit relative movement of each scow with respect to its adjacent scow.

SUMMARY OF INVENTION

According to one aspect of the present invention, there is provided in a wave making machine which is adapted to support a wave making plunger at the surface of a body of water for periodic movement between a raised position and a lowered position to generate waves, the improvement wherein the plunger has a front face and a back face which are oppositely disposed, the front face having a first portion which is inclined upwardly and forwardly, said back face being substantially normal to the surface of water whereby upon periodic motion waves are generated at the front face and substantially no waves are generated at the back face of the plunger.

According to a further aspect of the present invention, there is provided a wave making machine for generating waves on the free surface of a body of water comprising a support scow, a wave making plunger having a front face and a back face, the back face of the plunger being upright and the front face having a first portion which is forwardly and upwardly inclined, linkage means connecting the plunger and the scow to guide the plunger for substantially vertical movement relative to the scow, plunger drive means communicating with the plunger to effect movement of the plunger between a raised position and a lowered position to generate substantial waves in the direction away from said front face while generating little or no waves in a direction away from said back face.

According to a further aspect of the present invention, there is provided a wave making machine as described in the preceding paragraph wherein at least two scows as arranged in a side by side relationship and lateral linkage means is provided between each adjacent scow, said lateral linkage means being adapted to permit relative movement between adjacent scows while retaining them in a spaced relationship.

The invention will be more clearly understood after reference to the following detailed specification read in conjunction with the drawings wherein.

Figure 2:
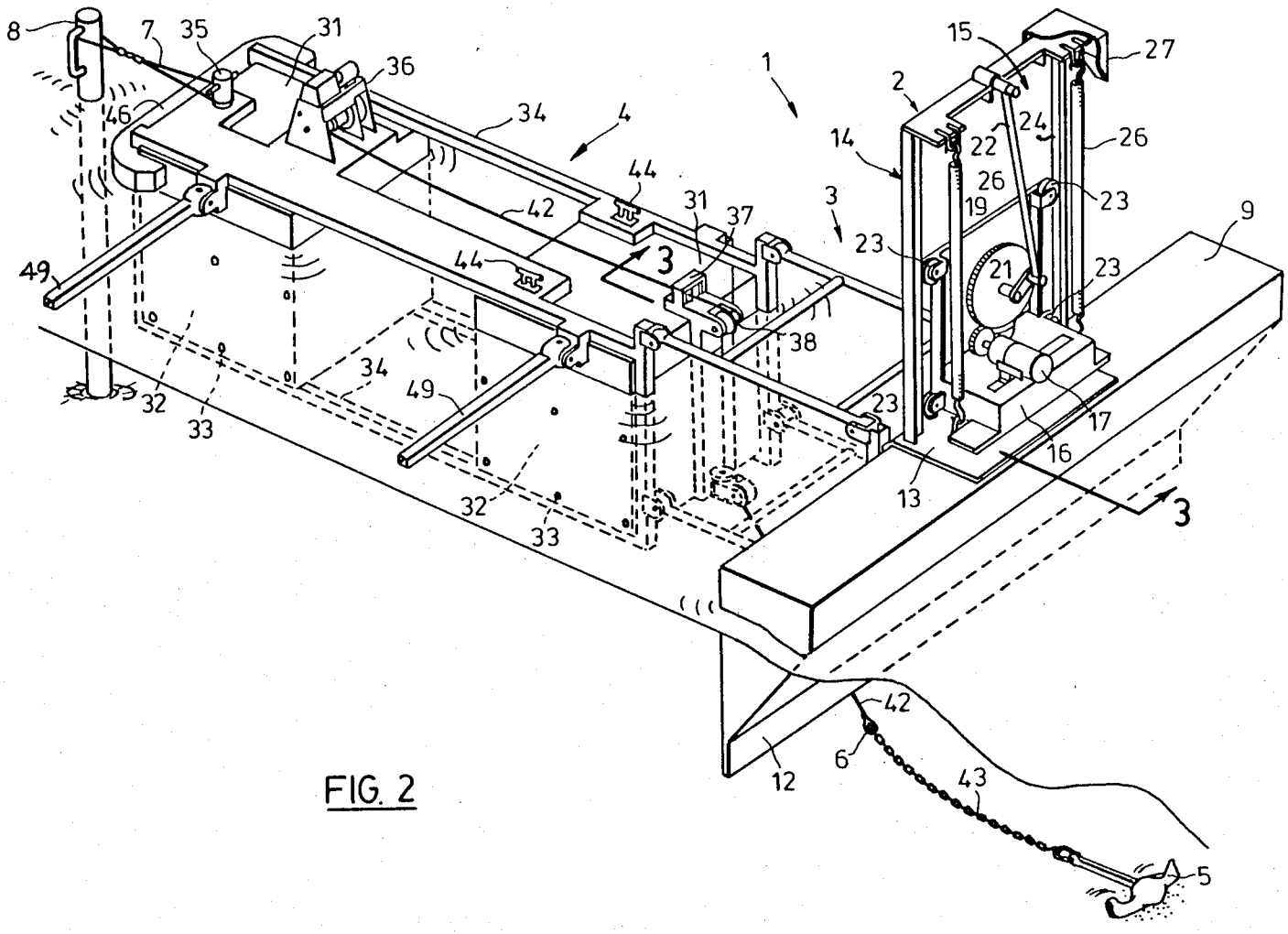
FIG. 2 is a pictorial view illustrating a wave making machine constructed in accordance with the embodiment of the present invention.

With reference to the drawings, the reference numeral 1 refers generally to a wave making machine constructed in accordance with an embodiment of the present invention. The wave making machine comprises a plunger assembly 2, a link assembly 3, and a support scow 4. In the embodiments illustrated in FIG. 2, a mooring post 8 is embedded in the bed of the waterway and connected to the scow 4 by means of a cable connection 7 and a bollard 35. A forward anchor 5 which has an anchor chain 43 connected thereto is connected by means of a coupling 6 to a cable 42 which extends around the fair lead 41 which is mounted at the bow of the scow and around horizontal roller 38 and between vertical rollers 37 and onto the winding drum of a winch 36. Mooring bitts 44 are mounted on the scow to facilitate mooring the scow. A fender 46 is located at the stern of the scow.

The plunger assembly 2 consists of a plunger member 9 which has a back face 10 which is planar and vertically oriented and a front face which includes an inclined portion 11 which extends upwardly and forwardly. A plunger fin 12 extends along the lower edge of the plunger. The plunger member 9 has a sealed hollow chamber formed therein which provides buoyancy.

A base plate 13 is mounted on the upper face of the plunger 9 and supports a frame 14 which extends upwardly therefrom. An oscillator drive mechanism generally identified by the reference numeral 15 is slidably mounted on the frame 14 and consists of a weight box 16, an electric motor 17, reduction gearbox 18, gearwheel 19, crank 21, connecting rod 22, guide wheels 23 and tension springs 26. The guide wheels 23 are supported on a back plate which extends upwardly from the weight box and runs along the vertical rails 24 provided by the frame 14. The connecting rod 22 connects the crank 21 to the upper transverse member of the frame 14. Tension springs 26 connect the weight box 16 to the upper transverse member of the frame 14 and normally urge the weight box 6 to the raised position. In use by driving the motor 17, the crank 21 is rotatably driven thereby causing the weight box 16 to oscillate vertically in the frame 14 which in turn causes the plunger 9 to react and to move between a raised position and a lowered position to generate waves. A cover 27 is provided which encloses the oscillating drive mechanism.

The link mechanism 3 which connects the plunger to the scow consists of a double set of link arms hingedly connected at the back face of the plunger 11 and at the bow end of the scow 4. The link arms are arranged in parallel so as to provide a parallelagram linkage which serves to maintain the back face 10 of the plunger substantially vertical during oscillating movement. In use, the plunger is caused to oscillate by movement of the weight box.

The support scow 4 consists of fore and aft flotation tanks 31 which are located above fore and aft ballast tanks 32. The flotation and ballast tanks are connected by longitudinal frame members 34 to form a rigid assembly which is buoyant in the water. Water is admitted to the ballast tanks 32 through vent holes 33 which open through the side walls thereof.

In use, the motor 17 is powered from a suitable source of electrical power (not shown) to drive the crank 21. Rotation of the crank 21 causes periodic motion of the plunger 9 relative to the surface of the water which in turn causes substantial variations in the liquid displacement of the plunger. Because water is substantially incompressible, the period displacement variations are conveyed to the surface of the water as wave action. By providing the plunger with a planar back face 10 and an extension fin 12, in the plane 70 and by oscillating the plunger in the plane 70, I have found that it is possible to reduce the wave action emanating from the back face of the plunger to an extent that it is substantially insignificant. Substantially the full differential displacement takes place at the front face of the plunger.

Figure 3:
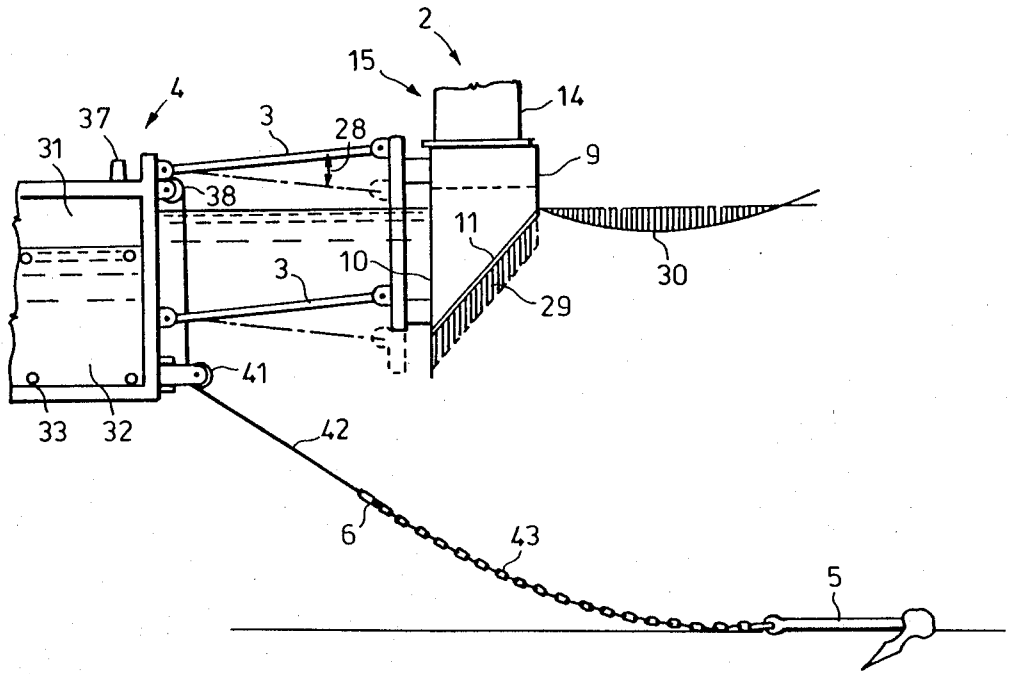
FIG. 3 is a side view of a wave making machine taken in the direction of the arrow 3—3 of FIG. 2.

As shown in FIG. 3 of the drawings, the area 30 of the wave profile which extends below the water level will approximately equal the area 29 representing the differential displacement of the plunger. In order to maximize the efficiency of wave generation, it is important to restrict horizontal oscillations of the plunger and this is achieved by providing a ballast weight 33 in the support scow and ensuring that the length of the link arms which connect the plunger to the scow are sufficient to ensure that the angle 28 between the extreme positions of the link arm does not exceed about 15 degrees.

Mooring bitts 44 are provided for use when towing the units and may also be used for mooring the scow to a conventional wharf by arranging the scow so that the fender 46 rests against the wharf side and using the mooring bitts and bollard for tying up the scow.

In most applications it is anticipated that a plurality of wave making machines will be required to work in concert. This is achieved by connecting the scows in a side by side relationship using connecting rods 49 which are connected through universal joints to adjacent scows. The flexible connection provided by the connecting rods 49 and the universal joints permit adjacent scows to move independently of one another under the influence of movements in the body of water such as wind driven waves or swell.

Figure 1:
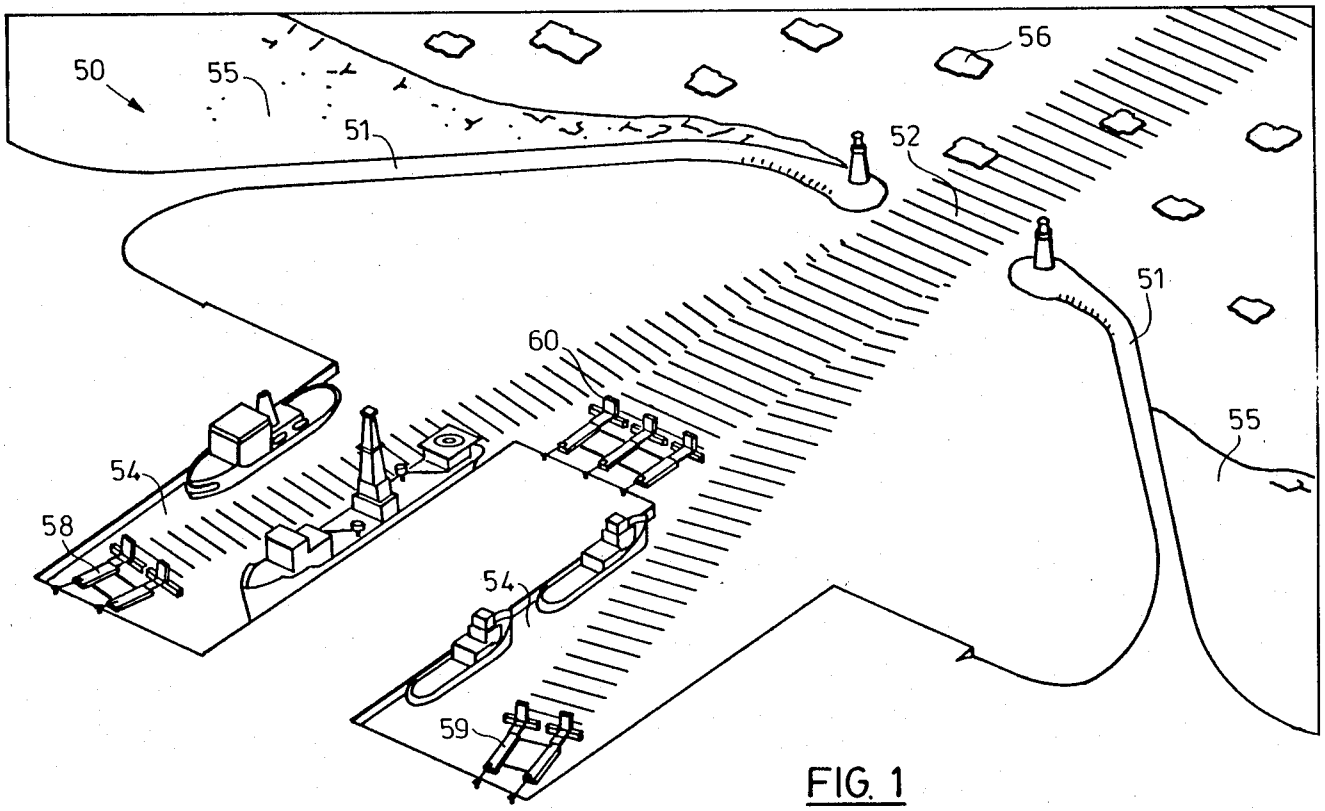
FIG. 1 is a pictorial view illustrating the manner in which a plurality of wave making machines may be located with respect to a body of water.

FIG. 1 of the drawings illustrates a typical sea harbor in a cold environment with typical ice manifestations in the sea outside the harbor. The harbor 50 is located behind break waters 51 and the harbor entrance 52 and includes a harbor basin 54. Natural ice conditions outside the harbor includes shore fast ice or bottom fast ice 55 near shore and ice floes or moving ice 56 offshore.

Under cold conditions shore fast ice will form inside the harbor and navigation activities will produce additional brash ice which will increase the difficulty experienced in maneuvering ships which require berthing.

The wave making machines of the present invention may be employed in this environment to provide continuous removal of harbor ice to sea and thereby improve navigational conditions inside the harbor. With reference to FIG. 1, an assembly of wave making machines is positioned as shown at 60 to generate a wave train travelling across the harbor and out through the harbor entrance. Wave making assemblies 58 and 59 are located in the harbor basins and are directed to generate wave trains which converge and merge with the wave train of assembly 60. This wave train pattern serves to clear ice from the harbor basins and the harbor entrance. The ice clearing action depends on the agitated waters ability to suspend or break up surface formed ice in the form of frazil ice or brash ice and on the slow mass transportation of upper water layers inherent in wave action. The disposal of transported ice load outside the harbor at sea is effected by natural sea currents in an expansive sea of moving ice.

The wave making machines of the present invention may also be installed in lakes and in open water reservoirs to improve or maintain the water quality and to prevent undesirable effects of stagnation. The formation of a wave train serves to cause mixing of the water in the surface layer to a substantial thickness and serves to transport the upper layer of water over great distances to a distant shore and can prevent algae bloom which must otherwise be treated with chemicals.

The wave making machine is preferably fabricated from materials commonly used in ship building and boat building. The plunger 9 may be made from steel plate, aluminum, fiberglass or the like. In sea water applications rust protective coatings may be applied to exposed surfaces. The wave making machine of the present invention may be constructed so as to have any required proportions appropriate to the installation in which it is to be used.

By way of example and without limiting the scope of the present invention the plunger cross-section may measure approximately 1.5 meters (5 feet) by 2.5 meters (8 feet) to produce 0.6 meter (2 foot) high and 6 meters (20 feet) long waves. With a plunger length of 12 meters (40 feet) and the length of the support scow equal to 9 meters (30 feet) the total displacement weight of the corresponding unit wave maker will be of the order of 20 metric tons (20 long tons) and it would require a 15 H.P. engine to operate or the plunger cross section may measure approximately 2.2 meters (7 feet) by 4.0 meters (13 feet) to produce 1 meter (3 foot) high and 10 meter (30 foot) long waves. With a plunger length of 20 meters (65 feet) and the length of the support scow equal to 15 meters (50 feet) the total displacement of the unit wave maker would be 65 metric tons (65 long tons) and it would require a 85 H.P. engine to operate.

The unit wave maker as conceived can be dismantled for overland transport (from place of manufacture to site of operation or from one site to another) by road or rail if it is small enough. With reference to the above examples the 15 HP wave maker as described would represent approximately the maximum size that can be moved by highway transport and the 85 H.P. the maximum size moveabale by rail. Larger wave makers must be moved via water transport.

Various modifications of the unit wave maker according to the present invention will be apparent to those skilled in the art. For example: The weight displacement machinery can be arranged differently (using rocker arms instead of guide rails and guide rollers) as long as the proposed machinery has low maintenance requirements.

It will also be understood that link means between two unit wave makers can be modified so that the proposed double connector rods with universal joint attachments can be replaced with more rigid connections depending on the environmental conditions at the site of the installation.

In order to synchronize adjacent wave makers of an integral installation the use of syncro motors or control means can be employed. The electric motors can also be replaced by controlled hydraulic drive.

It is general knowledge that waves from a single short wave machine travelling across an unconfined water surface will suffer early decline due to wave diffraction whereas waves from a wave machine installation having a total length which is 7 to 10 times the length of the waves being produced will suffer only minor height loss during their propagation and will travel very great distances. The unit wave machines of an (integral) wave machine installation need not operate in phase with each other to produce a far reaching train of wave action.

From the foregoing it will be apparent that the present invention provides a simple and efficient wave making machine that can withstand any expected environmemtal assault.

I claim:

1. In a wave making machine which is adapted to support a wave making plunger at the surface of a body of water for periodic motion between a raised position and a lowered position to generate waves, the improvement wherein said plunger has a wedge shaped upper portion and a thin fin which extends downwardly from the wedge shaped portion, said plunger having a front face and a back face which are oppositely disposed, said front face having a first portion which is downwardly and rearwardly inclined and forms the front face of the wedge shaped portion and a second portion which extends parallel to the back face and forms the front face of the fin, said back face being substantially planner and extending normal to the surface of the water said thin fin serving to space the lower edge of the plunger from the lower end of the inclined first portion of the front face whereby upon periodic motion waves are generated at the front face and substantially no waves are generated at the back face of the plunger.

2. A wave making machine for generating waves on the free surface of a body of water comprising;

(a) a support scow;

(b) a wave making plunger which has a wedge shaped upper portion and a thin fin which extends downwardly from the wedge shaped portion, said plunger having a front face and a back face, the back face being planar and upright and the front face having a first portion which is downwardly and rearwardly inclined and forms the front face of the wedge shaped portion and a second portion which extends parallel to the back face and forms the front face of the fin;

(c) linkage means pivotally connecting said plunger and said scow to guide said plunger for a substantially vertical movement relative to said scow;

(d) plunger drive means mounted on said plunger to effect movement of said plunger between a raised position and a lowered position to generate substantial waves in a direction away from said front face while generating little or no waves in a direction away from said back face.

3. A wave making machine as claimed in claim 2 wherein said linkage means comprises parallelogram linkage means having first end pivotally connected to said plunger and a second end pivotally connected to said scow said linkage means having a sufficient length to space the plunger a substantial distance from the scow so as to be independently movable with respect to the scow.

4. A wave making machine as claimed in claim 2 wherein said plunger comprises a buoyant transversely elongated hull.

5. A wave making machine as claimed in claim 2 wherein said scow comprises fore and aft buoyancy tanks each having an underlying ballast tank.

6. A wave making machine as claimed in claim 2 further comprising mooring means comprising rearward restraining means and forward flexible anchorage means.

7. A wave making machine for generating waves on the free surface on a body of water comprising;

(a) at least two support scows arranged in a side by side relationship, (b) linkage means pivotally connecting and extending laterally between adjacent scows and adapted to permit relative movement between adjacent scows while retaining them in a spaced relationship, (c) a wave making plunger associated with each scow, each wave making plunger having a wedge shaped upper portion and a thin fin which extends downwardly from the wedge shaped portion, each plunger having a front face and a back face, the back face being planar and upright and the front face having a first portion which is downwardly and rearwardly inclined and forms the front face of the wedge shaped portion and a second portion which extends parallel to the back face and forms the front face of the fin, and (d) linkage means pivotally connecting each plunged to its associated scow to guide the plunger for a substantially vertical movement relative to its associated scow, (e) plunger drive means mounted on each plunger to effect movement to each plunger between a raised position and a lowered position to generate substantial waves in a direction away from said front face of each plunger while generating little or no waves in a direction away from said back face of each plunger scow.

* * * * *